United States Patent [19]

Tozzi

[11] Patent Number: 4,766,855

[45] Date of Patent: Aug. 30, 1988

[54] PLASMA JET IGNITION APPARATUS

[75] Inventor: Luigi Tozzi, Columbus, Ind.

[73] Assignee: Cummins Engine Co., Inc., Columbus, Ind.

[21] Appl. No.: 946,150

[22] Filed: Dec. 23, 1986

Related U.S. Application Data

[63] Continuation of Ser. No. 799,255, Nov. 18, 1985, abandoned, which is a continuation-in-part of Ser. No. 766,517, Aug. 19, 1985, abandoned, which is a continuation of Ser. No. 636,169, Jul. 31, 1984, abandoned, which is a continuation of Ser. No. 515,557, Jul. 31, 1984, Pat. No. 4,471,732.

[51] Int. Cl.[4] ..... F02P 3/08

[52] U.S. Cl. ..... 123/143 B; 219/267

[58] Field of Search ..... 123/143 B, 253, 143 R, 123/144, 274; 219/267, 270; 361/264, 266; 313/231.4, 362; 315/111

[56] References Cited

U.S. PATENT DOCUMENTS

| | | | |
|---|---|---|---|
| 3,219,866 | 11/1965 | Dingman | 123/143 |
| 3,266,783 | 8/1966 | Knight | 123/143 |
| 3,445,722 | 5/1969 | Scott | 123/143 |
| 3,842,818 | 10/1974 | Cowell | 123/143 |
| 3,842,819 | 10/1974 | Waterson | 123/143 |
| 3,921,605 | 11/1975 | Wyczalek | 123/143 |
| 4,006,725 | 2/1977 | Baczek | 123/143 |
| 4,041,922 | 8/1977 | Abe | 123/143 |
| 4,122,816 | 10/1978 | Fitzgerald | 123/143 |
| 4,161,937 | 7/1979 | Gerry | 123/143 |
| 4,219,001 | 8/1980 | Kumagai | 123/143 |
| 4,230,448 | 10/1980 | Ward | 123/143 |
| 4,317,068 | 2/1982 | Ward | 123/143 |
| 4,332,223 | 6/1982 | Dalton | 123/143 |
| 4,338,897 | 7/1982 | Drumheller | 123/143 |
| 4,347,825 | 9/1982 | Suzuki | 123/143 |
| 4,393,333 | 7/1983 | Sakudo | 123/143 |
| 4,493,297 | 1/1985 | McIlwain et al. | 123/143 B |
| 4,494,404 | 1/1983 | Stallings | 123/143 |

FOREIGN PATENT DOCUMENTS

| | | | |
|---|---|---|---|
| 2838334 | 3/1980 | Fed. Rep. of Germany | 123/143 |
| 2347803 | 4/1976 | France | 123/143 |
| 2351521 | 12/1977 | France | 123/143 |

OTHER PUBLICATIONS

*Flame-Arc Combination*, by J. Lawton, K. G. Payne and Dr. F. J. Weinberg, *Nature*, vol. 193, pp. 736–738, Feb. 24, 1962.

*Augmenting Flames with Electric Discharges*, by D. C. C. Chen, J. Lawton, and F. J. Weinberg, Tenth Symposium (International) on Combustion, pp. 743–754, The Combustion Institute, 1965.

(List continued on next page.)

*Primary Examiner*—Raymond A. Nelli

*Attorney, Agent, or Firm*—Woodard, Emhardt,Naughton Moriarty & McNett

[57] ABSTRACT

A plasma jet ignitor apparatus for generating plasma from a plasma medium and for discharging the plasma as a jet into the combustion chamber of an internal combustion engine. The apparatus has a plug which has electrodes from which an arc is generated. The arc causes the plasma medium which is supplied to the plasma generation cavity to become plasma. The plasma generation cavity is cooperatively arranged with magnetic field generation means, electrode discharging means and plasma medium supply means. The cavity has an inlet opening adjacent the plasma generation location at the bottom of the cavity and an outlet orifice at the top of the cavity. The plasma is ejected as a plasma jet, with a ring vortex structure, from the cavity and through the orifice. The magnetic field generation means is disposed as a magnetic field coil acting on the arc. The magnetic field is created by the discharge of a capacitor at the time of the formation of the plasma in the cavity. The magnetic field accelerates the plasma out of the cavity through the orifice so that the plasma exits as a high velocity jet and achieves effective penetration with low energy expenditure. Timing means are also included for delivering gaseous or liquid plasma medium into the cavity, the discharge of the plasma generating energy and the triggering of the magnetic field.

OTHER PUBLICATIONS

*Flame Stabilization by Plasma Jet,* by A. J. Harrison and F. J. Weinberg, Proc. R. Soc. A 321, 95 (1971).

*Heat Transfer from Augmented Flames and Plasma Jets Based on Magnetically Rotated Arcs,* by J. B. Cox, A. R. Jones and F. J. Weinberg, Imperial College, London-1971-pp. 269-289.

*Quenching Magnetically Rotated Augmented Flames and Plasma Jets in Mixtures Containing Methane, Oxygen and Nitrogen,* by G. M. Colver and F. J. Weinberg, Imperial College, London (1972), pp. 375-391.

*Initiation of Electrically Augmented Flames,* by I. J. Jagoda and F. J. Weinberg, The Combustion and Flame Institute-1972.

*Associating Plasma Jets with Hydrocarbon Combustion,* by F. J. Weinberg, Industrie Chimique Belge., vol. 38-1973.

*A Note on Electromagnetically Induced Motion of Spark Ignition Kernels,* by A. J. Harrison and F. J. Weinberg, The Combustion Institute-1974.

*Effect of Nitrogen-Containing Plasmas on Stability, No Formation and Sooting of Flames,* by J. C. Hilliard and F. J. Weinberg, *Nature,* vol. 259, Feb. 19, 1976.

*Optical Study of Plasma Jets, by I. J. Jagoda and F. J. Weinberg, J. Phys. D: Appl. Phys. 13-1980-pp. 551-561.*

*Ignition by Plasma Jet,* by F. J. Weinberg, *Nature,* vol. 272, No. 5651, pp. 341-343-Mar. 23, 1978.

*Ignition by Radiation from Plasmas,* by J. E. Orrin, I. M. Vince, and F. J. Weinberg, Combustion and Flame, 37, pp. 91-93-1980.

*Performance of a Plasma Jet Igniter,* by B. Cetegen, K. Y. Teichman, F. J. Weinberg, A. K. Oppenheim, Society of Automotive Engineers, Inc. 1980.

*Optical Studies of Plasma Jets,* by I. J. Jagoda and F. J. Weinberg, The Institute of Physics-1980-pp. 551-561.

*An Electrically Efficient, Finely Tunable, Low-Power Plasma Generator,* by A. K. F. Chen, J. C. Hilliard, A. R. Jones and F. J. Weinberg, The Institutes of Physics-1980-pp. 2309-2320.

*A Study of Plasma Jet Ignition Mechanisms,* by J. E. Orrin, I. M. Vince and F. J. Weinberg, Eighteenth Symposium (International) on Combustion, The Combustion Institute-1981.

*The Destruction of Nitric Oxide by Nitrogen Atoms for Plasma Jets, by Houshang F. Behbahani, Arthur Fontijn, Klaus Miller-Dethlefs, and Felix J. Weinberg, Imperial College, London-1981.*

*Methods for Evaluating of Ignition Stimuli for Liquid Propellants,* by Klein, Carleton, Weinberg 1982.

*Energy and Radical Losses from Plasma Jet Igniters to Solid Surfaces,* by F. B. Carleton, I. M. Vince and F. J. Weinberg, Nineteenth Symposium (International) on Combustion/The Combustion Institute-1982-pp. 1523-1531.

*The Destruction of Nitric Oxide by Nitrogen Atoms from Plasma Jets:Designing for Thermal Stratification,* by Houshang F. Behbahani, Anne-Marie Warris an Felix J. Weinberg, Imperial College-1982.

*Plasma Jets in Combustion,* by F. J. Weinberg, Imperial College-IMechE-1983.

*Ignition Phenomenon in Energetic Liquids,* U.S. Army Armament Research and Development Command, by Carleton, Klein, Weinberg, Technical Report ARB-RL-TR-02514 (Aug. 1983).

*The Effect of Plasma Jet Ignition on Flame Propagation and Sooting at the Rich Limit of Flammability,* by I. M. Vince, C. Vovelle, and F. J. Weinberg, Combustion and Flame 56, pp. 105-112-1984.

*Chemical Activity and Transport Processes in the Vicinity of a Plasma Jet Igniter,* by R. M. Clements, PL. R. Smy, D. Topham, I. M. Vince, C. Vovelle, and F. J. Weinberg, Combustion and Flame 57, pp. 265-274, 1984.

*A Novel Ignition Device for the Internal Combustion Engine,* by A. J. J. Lee and F. I. Weinberg, *Letters to Nature,* vol. 311-Oct. 25, 1984.

*Ignition and Flame Stabilization by Plasma Jets in Fast Gas Streams,* by Anne-Marie Warris and Felix Weinberg, Twentieth Symposium (International) on Combustion/The Combustion Institute, 1984, pp. 1825-1831.

*Flame Initiation in Lean, Quiescent and Turbulent Mixtures with Various Igniters,* by P. M. Boston, D. Bradley, F. K. K. Lung, I. M. Vince, F. J. Weinberg, Automotive Engine Combustion.

*Optical Studies of Electrical Discharge-Liquid Propellant Interactions,* by Carleton, Cheriyan, Klein, Weinberg.

"*Plasma Jet Ignition in a Lean-Burn CFR Engine*", L. Tozzi, E. K. Dabora, 19th Symposium (International) on Combustion/The Combustion Institute, 1982, pp. 1467-1474.

"*The Plasma Jet*", Scientific American, Aug. 1957, G. M. Giannini.

"*Electric Plasmas for Flow Stabilization and Ignition in*

OTHER PUBLICATIONS

*Fast Gas Stream", Ph.D. Thesis by Anne-Marie Warris, Mar. 1983.*

*Nature,* vol. 272, 3/23/78, pp. 341-343, "Ignition by Plasma Jet", F. J. Weinberg et al.

Clements et al., "An Experimental Study of the Ejection Mechanism for Typical Plasma Jet Igniters", Combustion & Flame, 42:287-295 (1981).

Orrin et al., A Study of Plasma Jet Ignition Mechanisms, Dept. of Chemical Engineering & Chemical Technology, Imperial College, London, presented at the 18th Symposium (International) on Combustion held at the University of Waterloo, Canada 1980.

B. Cetegen et al., Performance of a Plasma Jet Igniter, SAE Technical Paper 800042 (1980).

Oppenheim et al., "Jet Ignition of an Ultra-Lean Mixture," SAE Technical Paper 780637, 1978.

Dale et al., "The Effects of Coaxial Spark Igniter on the Performance and the Emissions from an Internal Combustion Engine," Combustion & Flame, 31, 173-185 (1978).

Asik et al., Design of a Plasma Jet Ignition System for Automotive Application, SAE Technical Paper 770355.

Fitzgerald, Pulsed Plasma Igniter for Internal Combustion Engines, SAE Technical Paper 760764.

Topham et al., An Investigation of a Coaxial Spark Igniter with Emphasis on Its Practical Use, Combustion & Flame, 25, 187-195 (1975).

PLASMA JET IGNITION APPARATUS

CROSS REFERENCE TO RELATED APPLICATION

This application is a continuation of application Ser. No. 799,255 filed Nov. 18, 1985, now abandoned, which is a continuation-in-part application of my co-pending patent application Ser. No. 766,517 filed Aug. 19, 1985, abandoned, which is a continuation of my co-pending patent application Ser. No. 636,169 filed July 31, 1984, abandoned, which is a continuation of my prior patent application Ser. No. 515,557, filed July 31, 1984, now U.S. Pat. No. 4,471,732.

BACKGROUND OF THE INVENTION

The present invention relates to an ignition (ignitor) apparatus and, more particularly, to a plasma jet ignition apparatus for generating and discharging a jet of plasma for igniting fuel in combustion chambers of power sources such as internal combustion engines and the like.

Power sources such as internal combustion engines and the like rely on the combustion of fuel as their primary source of energy. This combustion usually occurs in one or more combustion chambers where the fuel is ignited by various ignition (ignitor) means (ignition by compression is normally used in diesel engines). The fuel that is most often used for these power sources are hydrocarbon based fuels such as gasoline and diesel fuel. In the past, the efficiency of the power sources which used these fuels was not as important as it is today. World events have made the crude oil from which many of those fuels are derived both expensive and in scarce supply. The need for refinement of that crude oil into various octane and cetane levels required for conventional ignition systems also adds to this expense. Additionally, environmental concerns have required that such power sources provide for improved efficiency and reduced emission of environmentally harmful exhaust by-products. This present situation calls for higher efficiency engines and less costly fuels.

Efficiency can be improved and emissions reduced by the use of special materials and structural changes to recuperate kinetic and thermal energies from the exhaust gases. Many attempts and designs have been directed to this aspect of the problem. The other means for improving efficiency and reducing emissions is by the improvement of the combustion process which can be accomplished through the use of efficient ignition apparatus for the combustion of lean air/fuel mixtures. Present ignition systems (in premixed engines) use conventional spark plugs which discharge a high voltage-low energy spark of approximately 0.01 Joules into the combustible mixture. This spark ignites a small volume of the mixture which in turn spreads through the volume of the mixture at the speed of the flame front to ignite the rest of the mixture. This mixture usually contains a high-octane gasoline fuel in a rich air/fuel mixture. Lean air/fuel mixltures do not burn as well because the flame speed of the front is reduced. Because the actual burning rate and ignition delay of this system depends upon the physical chemistry of the fuel extremely sophisticated combustion chambers have been necessary to produce slight improvements in ignition delay and burning rate. Additionally, high octane or high cetane fuels are needed which are more expensive and scarce. Moreover, because conventional spark plug ignition systems require relatively rich air/fuel mixtures for proper combustion it is important to precisely maintain this air/fuel mixture for efficient operation. Thus the conventional ignition systems limit the useful operating range of both low and high compression ratio internal combustion engines and the like.

An ignition system that could reduce the fuel ignition delay and promote faster burning rates would improve fuel economy, reduce emissions, and extend the useful operating range of the engine in terms of the air/fuel mixture and also in terms of the types of fuels that could be used. Running an engine with lean air/fuel mixtures presents numerous of the above advantages. The excess air provides for nearly complete combustion of hydrocarbons and carbon monoxide which are usually released as exhaust gases. The greater dilution of the charge with a lean mixture results in a lower peak temperature attained within the combustion chamber. This determines lower heat loss and reduces the formation of nitric oxide pollutants. The ratio of specific heats of fuel-air mixtures increases as leaner mixtures are employed. This means higher thermal efficiency at a given compression ratio. Output power may be controlled by just the variation of the air/fuel ratio in a lean mixture. This avoids the use of a throttle valve, which generally introduces pressure drops and a resulting decrease efficiency. Thus the use of lean mixtures results in a decrease in pollutant production and increases in efficiency.

As pointed out, conventional spark plugs do not efficiently cause combustion of lean mixtures and either misfiring occurs or there is no combustion. The typical spark of a conventional spark plug is highly localized and ignites a very small volume of fuel in the general vicinity of the surface of the spark. The small initial flame front produced from the spark propagates at a speed that is a function of the air/fuel ratio and of the chemical property of the fuel. With lean air/fuel ratios the combustion chemical kinetics is much slower. For efficient burning of such mixtures the flame speed must be increased.

The stratified charge engine is one structure which has been employed to attempt to gain the benefits of burning leaner air/fuel mixtures. The basis of this design is to provide for an initial combustion chamber in which a very rich air/fuel mixture is first ignited into a flame. Because of the pressure resulting from the chemical combustion this flame then enters the main combustion chamber to ignite a leaner mixture contained within the main chamber. The process requires chemical combustion in the initial chamber and the restructuring of the basic design of various internal combustion engines so that this initial chamber is provided for. These engines also require additional components, valves, and other design changes to present engines to allow for the use of the initial combustion of a rich mixture.

Another system for burning lean mixtures is based on the use of plasma jets. Basically these various systems create a jet of plasma which is introduced into the main combustion chamber. This jet causes the combustion of the fuel in the combustion chamber. The basic structure provides for an initial cavity in which a small amount of gas or the like is introduced. This gas is subjected to an electric discharge of high energy. This causes the gas to become a hot partially ionized gas otherwise known as plasma. Because of a great and quick buildup in pressure this plasma rushes out of an orifice in the cavity into the main combustion chamber as a jet or plume of plasma. Unlike the stratified engine flame this jet contains a much higher concentration of active chemical species (OH, H, N . . . radicals), and enters the combustion chamber at supersonic speeds. It appears that the presence of the radicals and the induced small scale turbulence enhances the initiation and the propagation of the flame front in lean air/fuel mixtures.

It has been recognized in the art that a plasma jet ignition system would have many advantages for use in internal combustion engines. Plasma jet ignitors can be adapted to be placed into internal combustion engines with relative ease. They offer an excellent means by which lean mixtures may be burned to extend the operating ranges of conventional engines. This of course provides all of the advantages of burning of lean mixtures in terms of fuel savings and pollutant reduction.

As has been pointed out the plasma medium, the magnitude and duration of the energy that generates the plasma, the size and shape of the plasma cavity and the size and shape of the orifice all affect plasma jet ignition effectiveness. The initial velocity of the plasma jet as it enters the main combustion chamber governs the penetration of the jet and its ability to cause small scale turbulence and enhance combustion. This velocity has been controlled by the dimensions of the plasma forming cavity and the ejection orifice. The duration and the amount of energy imparted to the plasma also governs the initial velocity. Higher energies must be discharged through the spark plug electrodes than for conventional spark plugs to generate plasma jets of sufficient pressure to be able to achieve the advantages of penetration and turbulence mentioned for enhanced combustion. These high energies tend to erode electrodes at a faster rate and to erode the orifice and cavity shape of the plugs.

The present invention provides for a plasma jet ignitor that can be easily adapted for use with internal combustion engines. It improves combustion and reduces pollutants by providing a jet of plasma that will ignite lean levels of fuel/air mixtures. The invention also provides for an external magnetic field means to accelerate the plasma jet so that the jet achieves good initial velocity so that it achieves the appropriate penetration into the combustion chamber to provide for the most efficient combustion of the fuel mixture. Because of the use of external means to accelerate the jet, the initial energy needed for the electrode discharge does not need to be as great. This means that the ignitor durability will be increased and that the entire system will be part of an actual power plant. Further advantages and features of present invention are discernable from the disclosure that follows.

SUMMARY OF THE INVENTION

A plasma jet ignitor apparatus for generating plasma from a plasma medium and for discharging the plasma as a jet. The apparatus comprises electrode discharge means for discharging energy to generate plasma from the plasma medium at a plasma generation location, magnetic field generation means and a plasma cavity. When the plasma medium is a liquid or gaseous, then the plasma cavity includes an inlet opening adjacent the plasma generation location and an outlet orifice. The inlet opening provides flow communication between the plasma medium location and the cavity. When the plasma medium is a solid material then the cavity is provided with an appropriate sleeve of that particular material. The magnetic field generation means is arranged to generate a magnetic field in order to accelerate plasma in the cavity out the outlet orifice so that a jet of plasma exits from the outlet orifice.

Accordingly, an object of the present invention is to provide an improved plasma jet ignition apparatus that is suitable for practical applications.

Related objects and advantages of the present invention will become apparent from the following figures and detailed description.

DESCRIPTION OF THE PREFERRED EMBODIMENT

Figure 1:
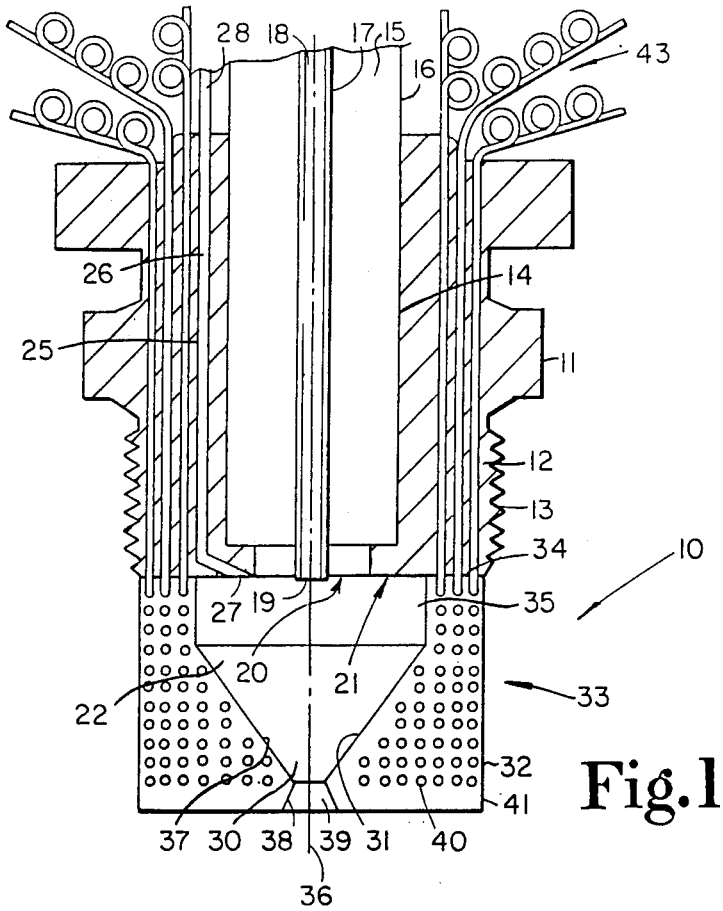
FIG. 1 is a partial side elevational view in cross section of a typical embodiment of a plasma jet ignitor according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is shown the preferred embodiment of a plasma jet ignitor apparatus 10 for generating plasma from a plasma medium and for discharging the plasma as a jet. The apparatus 10 is useable with an internal combustion engine for generating a jet of plasma into a combustion chamber of the internal combustion engine to ignite a fuel in the combustion chamber. The present structure as hereinafter described can be used to replace conventional spark plugs with the plasma jet ignition plug 11 shown in FIG. 1. Only the bottom portion of the plug 11 need be shown for an understanding of the invention because the upper portion has the structure of any conventional spark plug. Because the general external geometry of the plug 11 is like a conventional spark plug it can be placed in the conventional spark plug receptacle of a conventional internal combustion engine.

The plug 11 has a housing 12 which is made of metal and has means for attaching the plug 11 at a location adjacent the combustion chamber of an internal combustion engine. These means are the external screw threads 13 which mate with the threads of a conventional spark plug receptacle. Of course any other desired size of threads may be used. The housing has a central bore 14 in which electrode discharge means 15 are disposed within the housing 12 for discharging energy. The electrode discharge means 15 have a ceramic body 16 which is a cylinder of ceramic material which is received in the bore 14 of the housing 12. This ceramic body 16 has a central bore 17 in which an electrode 18 is disposed.

Figure 2:
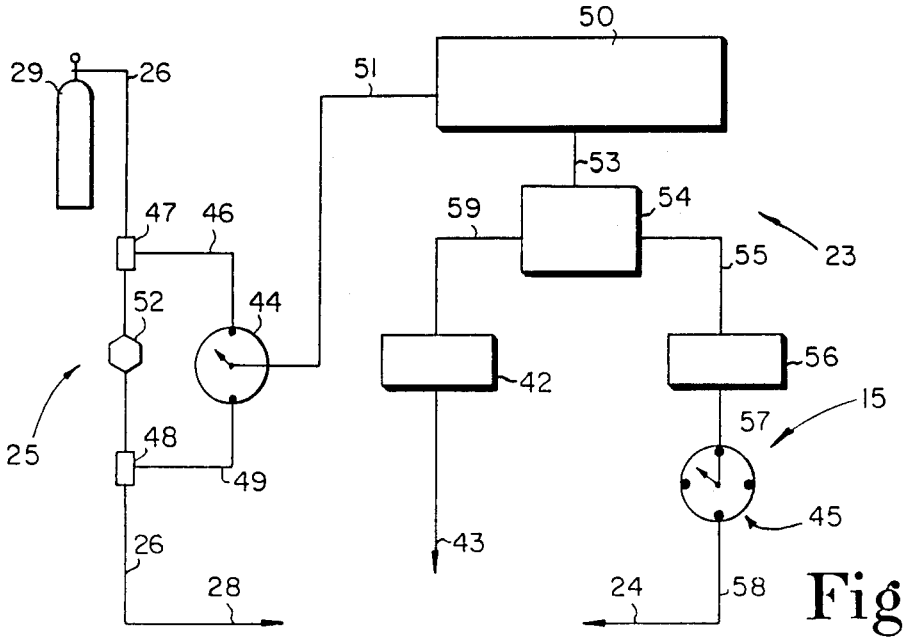
FIG. 2 is a block diagram of a plasma jet ignition system according to a typical embodiment of the present invention.
Figure 3:
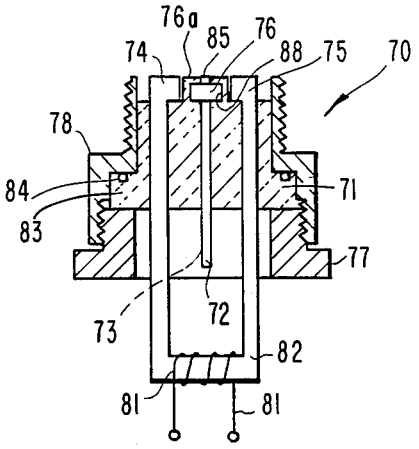
FIG. 3 is a side elevation view in full section of a typical embodiment of a plasma jet ignitor according to the present invention.
Figure 4:
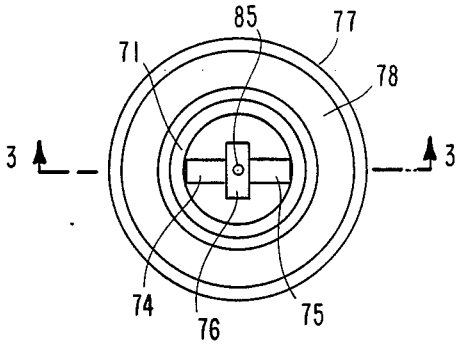
FIG. 4 is a top plan view of the FIG. 3 plasma jet ignitor.

The electrode 18 has a discharge end 19 from which electrical energy is discharged and a spark occurs in the spark gap 20 between the electrode end 19 and the ground electrode 21. This spark gap 20 is also adjacent the plasma generation location 22 at which the energy from the discharge of the electrode generates plasma from a plasma medium. The electrode discharge means further includes electrical means 23, as shown in FIG. 2 which is electrically engaged as shown diagrammatically at 24 with the electrode 18 for providing electrical energy to the electrode to cause a discharge of energy at the plasma generation location. As shown in FIG. 2 the source of the electrical energy is a conventional 12 volt power source 50. This source 50 is in electrical engagement by line 53 with a trigger voltage source 54. Line 55 electrically connects the trigger 54 with a high energy ignition coil 56 which is connected to distributor 45 and then to the electrode. The functioning of this electrical means in the preferred embodiment shall be more fully explained hereinafter.

The electrode discharge means includes plasma medium introduction means 25 as shown in FIGS. 1 and 2. The plasma medium means 25 have a plasma medium passageway 26 disposed in the housing 12. This passageway 26 has a plasma medium outlet opening 27 disposed adjacent the plasma generation location 22. The opposite second end 28 of the passageway 26 is disposed in flow communication with a plasma medium source 29 which contains a supply of plasma medium. Thereby a flow communication is established between the plasma medium source 29 and the plasma generation location 22 for introducing plasma medium to the plasma generation location. As shown in FIG. 2 the plasma medium passageway 26 has a first solenoid valve 47, then an injection calibrated cavity 52 which holds a, in the preferred embodiment a calibrated amount of plasma medium for calibrated injection into the cavity 30. There is also a second solenoid valve 48 down the line before the passageway 26 enters the plug 12. The functioning of this plasma medium introducing means in the preferred embodiment shall be more fully explained hereinafter.

In the preferred embodiment the plasma medium that is used is Hydrogen gas. Other types of plasma mediums are of course possible. Hydrogen gas has been found to reduce fuel ignition delay and to enhance the combustion caused by the plasma generated from the hydrogen. Nitrogen may be used as the plasma medium if it is desired to reduce nitrous oxides emissions. Fuel and water mixtures reduce hydrocarbon particulate emissions.

As shown in FIG. 1 the plug 12 has a plasma generation cavity 30 at its lower end. The cavity inner wall 31 is defined by a magnetic field generation means 33. The actual inner wall that is included as part of the magnetic field generation means, in the preferred embodiment, is an integral inner wall of the housing 12. An alternative design is to provide the inner wall as part of a shroud 32 that is securely attached to the housing 12 at its lower portion 34. The plasma cavity shroud 32 has an open portion 35 adjacent the plasma generation location 22. The open portion 35 is adapted to be secured to the electrode discharge means housing 12. The integral wall or the shroud provide two approaches by which the present invention can be achieved. One approach is the constructing of the magnetic field generation means integrally with the remainder of the plug 12. The other approach is the use of a shroud 32 which is attached to conventional plasma jet plug design so that the enhancement provided by the present invention's magnetic field generation means, as hereinafter explained, may be realized for those plugs also.

The cavity 30, whether defined by the housing or the shroud wall, has an inlet opening or open portion 35 adjacent the plasma generation location 22. The cavity also has an outlet orifice discharge means as shown by the orifice 36. The inlet opening or open portion 35 provides flow communication between the plasma generation location 22, the cavity 30 and the cavity discharge orifice means 36. The cavity 30 shown in FIG. 1 has a conical shape 37 towards the orifice 36 and the orifice 36 has a conical shape 38 towards the cavity 30. When the plug 12 is in an internal combustion engine the outlet orifice 36 is in flow communication with the combustion chamber so that the plasma jet goes from the cavity and into the combustion chamber to ignite the fuel in the chamber. In the preferred embodiment, the cavity 30 has a volume of approximately 50 cubic millimeters and the orifice 36 has an open diameter 39 of 1 millimeter. Variations in the cavity size and orifice diameter are possible and such variations will affect the velocity and penetration of the plasma jet and such variations are intended to be within the scope of the present invention.

The present invention provides magnetic field generation means 33 for creating a magnetic field to accelerate the jetting of the plasma from the plasma generation location 22 through the cavity 30 and out the orifice 36 as a jet. The magnetic field generation means 33 includes a magnetic field coil 40 disposed about and defining the plasma generation cavity 30. This field coil 40 is embedded in the preferred embodiment in a ceramic cap 41. This cap 41 of course can be integral with the plug housing 12 or it can be part of the shroud 32. The magnetic generation means 33 further includes magnetic field electrical energy means 42 electrically engaged 43 with the magnetic field coil 40 for introducing electrical energy into the field coil 40 to produce the desired magnetic field for the acceleration of the plasma out of the cavity 30 through the orifice 36. The electrical energy means 42 include the electrically engagement of the magnetic field coil 40 with the triggering device 54 by line 59. The functioning of these electrical energy means 42 in the preferred embodiment shall be described below.

The preferred embodiment of the present invention also has timing means 44 and 45 for timing the introduction of plasma medium by the plasma medium introduction means with the discharge of energy by the electrode discharge means with the acceleration of the plasma by the magnetic field generation means. The timing means include distributor 44 and distributor 45.

Distributor 44 is engaged with the plasma medium introduction means 25. One engagement is with a first solenoid valve 47 by line 46 and the second engagement is with solenoid valve 48 by line 49. Distributor 44 is powered by a conventional 12 volt power supply 50 through power line 51. Distributor 45 is electrically engaged by line 57 with the high energy ignition coil 56 and electrically engaged with the electrodes 18 by line 58. The timing means functioning for the preferred embodiment shall be more fully explained below.

The operation of the preferred embodiment will now be explained. The present invention provides for an apparatus and system for ejecting a jet of plasma into for example, a combustion chamber. This jet is accelerated by a combined action of a static pressure and an accelerating magnetic field. At the beginning of a cycle or initially the timing distributor 44 triggers solenoid valve 47 and the plasma medium which is hydrogen flows from the plasma medium source 29 to the calibrated injection cavity 52. At this time valve 48 is already shut off. In the preferred embodiment the injection cavity holds approximately 0.05 milligrams of hydrogen. Distributor 45 then shuts off valve 47 and triggers solenoid valve 48 and the calibrated amount of hydrogen flows through passageway 26l and is introduced into the 50 cubic millimeter plasma generation cavity 30 from outlet opening 27. Distributor 45 is timed relative to distributor 44 so that distributor 45 triggers the electrical means 23 for the electrode discharge means. This timing depends on the engine load but is usually only a few moments after the hydrogen enters the plasma generation cavity 30. In the preferred embodiment, this causes a high energy spark of approximately 0.7 joules to be discharged by the electrode 18 at the plasma generation location 22. This high energy spark causes the hydrogen to become a hot ionized gas otherwise known as plasma. In the preferred embodiment, due to the extremely short deposition time of approximately 50 microseconds at which the electrical energy is discharged, an abrupt increase in temperature and pressure is caused within the plasma cavity 30. Since this pressure is much greater than the pressure outside of the cavity, the plasma generated is ejected from the cavity 30 through the orifice 36.

To improve and control the penetration of the jet so that the most effective penetration will occur the magnetic field means 33 is energized during the plasma formation. The magnetic field electrical means 42 are connected to the power supply 50 through the trigger voltage source 54. The magnetic field electrical means 42 at the time of the electrode discharge cause a large amount of energy, of approximately 10 joules, stored in a capacitor to be discharged into the magnetic field coil 40 which is wound around the cavity 30. This creates an appreciable magnetic field which accelerates the plasma jet so that good penetration is achieved. With the dimensions recited herein as the preferred embodiment the plasma jet has been ejected by this invention to an approximate depth of 5 centimeters within a combustion chamber. Thereby good combustion results due to increased flame speed, turbulence, and larger flame front resulting in multi-point ignition.

An alternative and slightly more detailed embodiment of the present invention is illustrated in FIGS. 3–6 wherein jet ignitor apparatus 70 includes ceramic body 71, electrodes 72 and 73, magnetic poles 74 and 75, defined cavity 76, support 77 and holder 78. Magnetic poles 74 and 75 are created by the combination of external windings 81 and iron core 82, and are disposed on opposite sides of cavity 76 directly above the pair of substantially parallel electrodes 72 and 73 that form an arc gap at the bottom of the cavity on the opposite side from the outlet orifice 85. The upper ends of the electrodes are flush with the corresponding surface of the ceramic body such that the arc formed between the electrodes passes out of the respective ends and not out from the sides of each electrode body. This particular relationship controls and reduces heat loss thereby adding to the overall efficiency of the present invention.

Furthermore, the structure of the emerging jet produced by the arc occurring at the bottom of the cavity 76 and on the opposite side from the outlet orifice 85, is a ring vortex. There are two main advantages with the ring vortex structure. One advantage is that the penetration of a ring vortex has a weak dependency on the environment density, therefore it is particularly suitable for high-compression ratio and highly boosted modern engines. The other advantage is that, during its travel across the combustion chamber, the ring vortex progressively entrains air/fuel mixture and offers a better control on the ignition location.

The ceramic body 71 is formed with two passageways for receipt of electrodes 72 and 73. Also provided as part of ceramic body 71 is an outwardly extending, annular shoulder 83. Shoulder 83 abuts up against the top surface of support 77 and is clamped in place by the threaded engagement between holder 78 and support 77. An O-ring 84 is disposed between the top surface of holder 78 and the upper surface of shoulder 83 and provides in part the necessary sealing between components.

The upper portion of ceramic body 71 is relieved around and contoured so as to define cavity 76 which extends above the surrounding surface of body 71. Cavity housing **76*a* which defines the size and shape of cavity 76 is a generally rectangular solid and securely attached to the remainder of body 71. Cavity housing 76*a* includes a centrally disposed orifice 85 which opens outwardly from the top of cavity 76. Cavity housing 76*a* includes a surrounding wall 88 (see FIGS. 5 and 6) and the interior includes inwardly tapering, planar, rectangular surfaces 89 and 90 which terminate at the interior edges of orifice 85**.

As was illustrated in FIG. 1, some means of introducing the plasma medium into proximity with the electrodes 72 and 73 is required if the plasma medium is a liquid or gaseous substance. Although such means are not actually illustrated in FIG. 3 or 7, it is to be understood that the omission is only for drawing clarity and in order to focus FIGS. 3 through 7 on the design of the cavity and not every element of feature of the surrounding system or environment.

Figure 5:
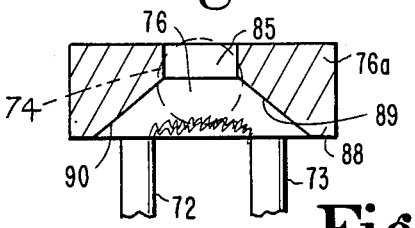
FIG. 5 is a partial, side elevation view of the FIG. 3 plasma jet ignitor (viewed at 90 degrees relative to FIG. 3).
Figure 5A:
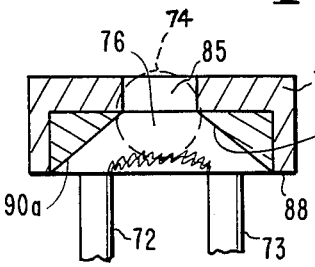
FIG. 5A is a partial, side elevation view of an alternative embodiment of the FIG. 1 plasma jet ignitor.
Figure 6:
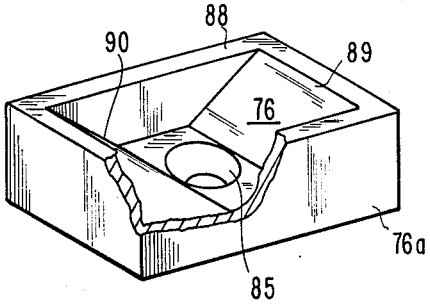
FIG. 6 is a perspective view of a cavity housing and defined plasma cavity comprising a portion of the FIG. 3 plasma jet ingitor with its top to bottom orientation inverted in order to illustrate the cavity contour.

In one embodiment of the present invention the plasma medium is initially a solid material and actually positioned in cavity 76. Referring to FIG. 5A, this alternative embodiment is illustrated. By fabricating the planar, rectangular surfaces **89*a* and 90*a* out of a special, solid plasma material such as polyetheretherketone, the plasma introduction means previously described is no longer necessary. These rectangular surfaces may be configured as a sleeve or insert which fits into the otherwise generally rectangular solid shape of cavity 76**. The solid plasma material undergoes a transformation when it is exposed to the high temperature of the electrode arc. A very small portion of the solid material vaporizes, chemical bonds are broken and the material goes into plasma as radicals. The rate at which the solid material is reduced by this process is of the same order of magnitude as the wear rate or rate of erosion of the electrodes. A material believed to be suitable for the solid plasma material for the present invention is offered by a United Kingdom company called, Imperial Chemical Industries (ICI), and has a commercial name of "VICTREX". The VICTREX polyetheretherketones (PEEK) is a high-temperature thermoplastic resin which is suitable for processing by extrusion or injection molding.

Electrodes 72 and 73 are disposed and arranged such that their exposed ends are substantially flush with the lowermost edge of the cavity housing. These two electrodes are inset from the housing edges so as to be in line with rectangular surfaces 89 and 90 and positioned generally symmetrically on opposite sides of orifice 85. The diameter size of orifice 85 is critical, and in the exemplary embodiment the diameter of orifice 85 is approximately one-third the length of the cavity. Correspondingly, the projected lengths of rectangular surfaces 89 and 90 are each approximately one-third of the cavity length. The cavity volume is in the range of 10–20 cubic millimeters.

As previously described, magnetic poles 74 and 75 are disposed on opposite sides of the cavity and as should be noted, are aligned with each other in order to provide the magnetic field necessary for accelerating the plasma jet, as previously described. The direction of the arc between the two electrodes and the fact that the magnetic field is arranged at 90° (normal) to the arc controls the direction of the plasma jet. Following the left-hand rule and the vector relationship between magnetic and electrical fields, the force vector which causes plasma jet acceleration is represented by the following equation:

$$F = J \times B \qquad \text{(Equation 1)}$$

wherein J is the arc vector, B is the magnetic field vector and F is the acceleration force vector. The direction of plasma jet acceleration is always 90° relative to the plane of the two vectors J and B. The acceleration vector is maximized when J and B are at 90° to one another (exemplary embodiment) but an acceleration vector is still present, only smaller, at relationships other than 90° between the J and B vectors.

Figure 7:
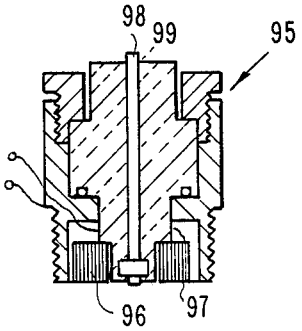
FIG. 7 is a side elevation view in full section of an alternative plasma jet ignitor having an inverted orientation.

Referring to FIG. 7, an alternative embodiment to that of FIGS. 3–6 is illustrated. Jet ignitor apparatus 95 is virtually identical to apparatus 70 with the exception of the style of the iron core, windings, and magnetic poles. In FIG. 7 the windings are internal to the holder and the ceramic body is styled differently in order to accommodate this change. Magnetic coils 96 and 97 are still disposed on opposite sides of the cavity and 90° apart from the two, substantially parallel electrodes 98 and 99.

Figure 8:
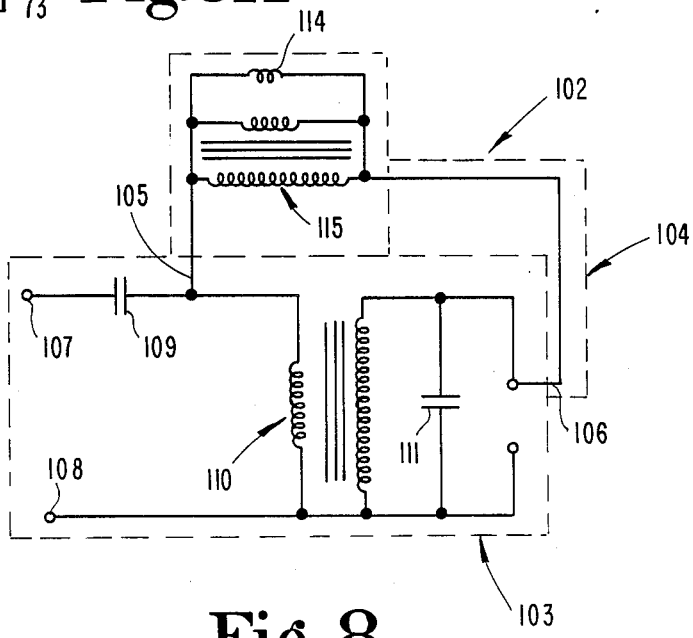
FIG. 8 is a schematic diagram of a suitable circuit for the various plasma jet ignitors of the present invention.

Referring to FIG. 8, associated circuitry which is cooperatively arranged with apparatus 70 (or alternatively apparata 10 or 95) is illustrated. Circuit 102 is arranged into two portions 103 and 104 which are interconnected by electrical conductive lines 105 and 106. Circuit portion 103 includes an AC voltage input (potential) across terminals 107 and 108, storage capacitor 109, voltage transformer 110 and capacitor 111. Circuit portion 104 includes magnetic field coil 114 and current transformer 115. The function of circuitry portion 104 is to feed high current into the current transformer 115 so that more energy can be supplied to the magnetic field coil 114.

While working with the technology of the present invention in evaluating various alternatives and design parameters, a number of factors such as positional relationship, dimensions, shapes and sizes were evaluated. In each instance such criteria as efficiency and reliability were assessed. These various factors are reviewed hereinafter, and while the foregoing structural and performance descriptions of the exemplary and alternative embodiments are certainly consistent with the evaluation of these factors, the following discussion of such relationships, dimensions, shapes and sizes provides additional insight into some of the details of the present invention, its application, critical aspects, and its adherence to and utilization of the laws of physics.

The arc current and cavity volume are critical parameters and deterimine the ignitor sensitivity to the external magnetic field. Only for low energy density ignitors, the external magnetic field can be beneficial. If the magnetic coil is in series with the arc gap, then a considerable plasma velocity increase can be obtained.

A limit value for the energy density ($E_D$) above which the plasma jet is insensitive to the magnetic field exists and is related to the environment pressure (P) by the following formula:

$$E_{Dlimit} = 6 \times P^{0.45} \text{(j/mg)} \qquad \text{(Equation 2)}$$

In a low current plasma jet, the ratio between magnetic forces and thermal forces can be as high as 100. The increase in plasma velocity due to the presence of a magnetic field is proportional to the square root of the number of turns in the magnetic coil. A narrow magnetic field will produce a more aerodynamic jet.

An electric arc is defined as a low voltage/high current discharge. On the other hand, a high voltage/low current discharge is called a spark. An arc generates a much higher gas temperature than a spark and it can be very effective in producing high density plasma. As with any electrical conductor, an arc obeys the laws of electromagnetism. If (J) is the current density vector in the arc and (B) is a magnetic induction vector orthogonal to (J), a force ($J \times B$) will act on the arc in a direction perpendicular to both (J) and (B). The amplitude and velocity of the arc deflection are also depending on (J) and on the aerodynamic resistance (R) encountered during the arc motion. The aerodynamic resistance is proportional to the arc surface area (A), to the environment density ($\rho_\infty$), the square of the arc velocity (V) and to drag coefficient ($C_D$) as expressed below:

$$R \propto A \rho_\infty V^2 \cdot C_D$$

Arc deflection velocities up to 30 m/s have been measured at ambient conditions, for a magnetic induction intensity of B = 1.6K gaus and for an arc current of i = 8 amps. The maximum value for the magnetic induction (B) is obtained when the electrodes are parallel and it is given by the following formula:

$$B = \frac{\mu_o i}{\pi d} \qquad \text{(Equation 3)}$$

where ($\mu o$) is the magnetic permeability, (i) is the current in the electrodes and (d) is the distance between the two electrodes. In order to contain the erosion of the electrodes and of the cavity, the current value (i) should be kept as low as possible, and the consequential reduction in (B) should be compensated by the addition of an external magnetic field. This can be accomplished by means of a solenoid properly wound around the arc discharge location. The magnetic induction along the axis of a solenoid is given by:

$$B_3 = \frac{\mu_o N i}{L} \quad \text{(Equation 4)}$$

where (N) is the number of turns, (i) is the current in the solenoid widing and (L) is the length of the solenoid. Comparing Equations 3 and 4:

$$B_3/B = \frac{N\pi d}{L} \quad \text{(Equation 5)}$$

When L=3d, $B_3/B$ is proportional to N. In practical application, the number of turns (N) can be easily made equal to 100. This means tht the presence of an external solenoid will increase the magnetic induction (B) by a factor of 100.

During an arc discharge, a large quantity of heat is dissipated in the immediate vicinity of the arc. This heat ionizes the gas around the arc and creates plasma. If the arc moves, then plasma is produced along the arc pattern. If plasma is needed far away from the electrode's gap, then the arc can be displaced. This generates the typical luminous plume. From an aerodynamic standpoint, the arc motion in a gas is similar to the motion of a solid body in a low density medium. The high temperature developed within the arc channel acts as a thermal barrier and offers an aerodynamic resistance to the arc motion. If we assume that the arc channel of hot gases is cylindrical, then the drag force will be proportional to:

$$C_D a s u^2 \rho_\infty$$

where ($C_D$) is the drag coefficient, (a) is the channel radius, (s) is the arc length, (u) is the arc displacement velocity and ($\rho\infty$) is the environment density. The momentum equation for the arc moving away from the gap can be written as:

$$\frac{d}{dt}(\rho\pi a^2 s)\mu = J \times B(\pi a^2 s) - \rho_o a s \mu^2 \rho_\infty \quad \text{(Equation 6)}$$

Since the mass of the hot gas in the arc channel can be considered constant Equation 6 becomes:

$$\frac{du}{dt} = \frac{iB}{\rho\pi a_2} - \frac{C_D \rho_\infty \mu^2}{\rho\pi a} \quad \text{(Equation 7)}$$

in which ($\rho$) is the density of the hot gas in the arc channel. For a square pulse, in which (i) and (B) are constant with time, the approximate integration of Equation 7 leads to the expression of the asintotic arc velocity:

$$\mu = \frac{iB}{aC_D\rho_\infty} \quad \text{(Equation 8)}$$

Equation 7 and its approximate solution, Equation 8, can be used to describe the dynamics of an arc displaced by a magnetic field.

The plasma produced by an arc discharge is a partially ionized hot gas and, as already explained, is produced around the arc. If the arc is accelerated the plasma around it will also be accelerated and it will form a luminous plume. For steady arcs the plasma produced is far from steady and has a pronounced tendency in moving away from the arc channel. This phenomenon is due to the sudden increase in the gas temperature around the arc. If the arc is confined in a small cavity, then the increase in pressure can be considerable and if one provides the small cavity with an aperture, then a jet of plasma will be generated. This is the common mechanism used up to now for squirting plasma far away from the electrode gap. For very high discharge energy densities this mechanism produces highly turbulent and penetrating jets. When low discharge energy densities must be used, then the jet effectiveness decays dramatically. The pressure in the cavity after the dissipation of the specific energy Q is given by:

$$P = \frac{RoQ}{VCp} + Po \quad \text{(Equation 9)}$$

and since Ro/VCp is usually a large number, a reduction in Q will always cause a drastic reduction in P. The expression for magnetically accelerated plasma is:

$$\mu = \frac{iB}{aC_D\rho_\infty} \quad \text{(Equation 10)}$$

in which for low specific energies an increase in (B), by means of an external magnetic field and the decrease in (a) and ($C_D$), due to the higher pressure, can very well compensate the decrease in current (i) and the increase in density ($\rho\infty$). In principle an optimized design would maximize both the thermal and the magnetic forces. Equation 9 says that in order to maximize the thermal forces and for a given energy pulse, the cavity volume should be as small as possible. This maximization criterion becomes more complicated in the case of magnetic forces. As quantified in Equation 10, the numerical value of the drag coefficient $C_D$ should be as small as possible. This condition can be achieved only if the discharge occurs in an aerodynamic cavity. For a low current arc it can be shown that the thermal forces are very small compared to the magnetic forces. The ideal jet velocity produced by magnetic forces can be about 100 times larger than the ideal jet velocity produced by thermal forces only. For this reason, a low current plasma jet should be designed mainly to maximize magnetic forces. Experimental results have demonstrated that for a parallel electrode configuration there exists a limit value of the arc current (i) above which the addition of an external magnetic field does not improve the plasma acceleration. An approximate figure for the threshold value at ambient conditions is: $i_{limit}=15$ amps.

An explanation of the existence of such a threshold value can be seen in the fact that for a higher current the self-induced magnetic force is so strong that it can produce the complete stretching of the arc, therefore the addition of external forces does not produce any visible effect. At higher pressure the current limit value ($i_l$) is expected to increase as the aerodynamic forces acting on the arc retard its complete stretching. Another limitation in the use of magnetic forces as a propulsive media was found in the size and geometry of the cavity. If the cavity was too small or if the geometry was not sutable to minimize the arc contact with the surfaces, then the arc growth was arrested and the magnetic forces could not be fully exploited. More specifically, it was found that for discharge energy density of the order of 6 J/mg or less the plasma jet velocity and penetration was significantly improved by the addition of an exxternal magnetic field. For energy densities higher than 6 J/mg the plasma jet was practically insensitive to the addition of an external magnetic field. This energy density limit is also expected to increase with pressure. An empirical relation would be:

$$E_{Dlimit}=E_{Do}\times P^{k}\ (\text{J/mg})$$

where:

$E_D$ is the energy density limit above which the external magnetic field does not produce any significant effect;

$E_{Do}$ which equals 6 J/mg is the experimental value at ambient conditions;

P is the environment pressure; and k which equals 0.45, was experimentally determined.

The depth (d) of the cavity should be equal to the radius of the maximum useful arc stretch beyond which the arc starts expanding prevalently in the transverse direction. To reduce the direct contact between the fully stretched arc and the cavity lateral walls, the length (l) should be larger than the fully stretched arc diameter obtained in absence of the plasma at the electrode's root.

The parallel electrode configuration with the arc gap at the bottom of the cavity on the opposite side from the outlet orifice and with the transverse magnetic field acting on the arc gap presents a simpler principle of operation than the surface electrode configuration with an axial magnetic field. The starting point for such a design is in the selection of an appropriate electrode diameter. As a general criterion a smaller electrode diameter maximizes the magnetic induction. Furthermore, it allows for a smaller magnetic gap which increases the external magnetic field intensity and reduces the width of the ignitor to fit a standard spark-plug thread. The electrode protrusion in the cavity should be as short as possible. For a longer protrusion a significant reduction in the luminous plume length was observed. Perhaps the longer electrodes acted as a quenching agent during the arc growth. For a given set of ignitor operational conditions, i.e., arc current, energy, electrode diameter and gap, and environment pressure, the volume and the geometry of the cavity can be determined. The orifice diameter must be large enough to let the arc go through without disrupting it. On the other hand, too large of an orifice would determine a large front area jet and would increase the aerodynamic resistance.

Experimental results demonstrated that the jet's structure, produced by the arc occurring at the bottom of the cavity and interacting with a transverse magnetic field, consists in a ring vortex. The organized motion of a ring vortex is produced with a small amount of energy whereas the random motion of a turbulent jet requires higher energy. A second advantage is in the more progressive entrainment by the surrounding medium into the ring vortex. This factor allows for a longer jet penetration and a more effective preservation of the radicals from premature recombination.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A plasma ignition apparatus for generating plasma and for propelling said plasma from said ignition apparatus for ignition external to said ignition apparatus, said ignition apparatus comprising:

means defining a cavity;

a solid plasma medium insert disposed within said cavity;

electrical energy discharge means cooperatively arranged with said cavity and arranged for generating an electrical energy discharge in the vicinity of said solid plasma medium insert and for transforming a portion of said solid plasma medium insert into generated plasma radicals within said cavity, said electrical energy discharge being at a level sufficient to generate said plasma radicals and below a level at which the generated plasma radicals are propelled from the cavity and capable of ignition external to the cavity, whereby electrode erosion is minimized; and magnetic field generation means establishing a magnetic field within said cavity, said magnetic field providing a supplemental propelling force on said generated plasma radicals, the strength of said magnetic field being predetermined based upon the energy level of said discharge and the geometry of said cavity so as to propel the generated plasma radicals from the cavity for ignition external to the cavity, whereby ignition and flame propagation are enhanced.

2. The plasma ignition apparatus of claim 1 wherein said magnetic field generation means includes a pair of magnetic poles aligned with one another on opposite sides of said cavity.

3. The plasma ignition apparatus of claim 1 wherein said electrical energy discharge means includes a pair of substantially parallel electrodes, each electrode having an electrode discharge end, said electrode discharge ends being disposed adjacent said cavity.

4. The plasma ignition apparatus of claim 1 wherein said electrical energy discharge means is designed and arranged such that the electrical discharge is substantially perpendicular in its direction to said magnetic field.

5. The plasma ignition apparatus of claim 1 wherein said magnetic field generation means includes a pair of magnetic poles aligned with one another on opposite sides of said plasma cavity, and wherein said electrical energy discharge means includes a pair of substantially parallel electrodes, said electrical discharge being established between said pair of electrodes and having a direction which is substantially perpendicular to said magnetic field.

6. A plasma ignition apparatus for generating plasma and for propelling said plasma from said ignition apparatus for ignition external to said ignition apparatus, said ignition apparatus comprising:

means defining a cavity;

a solid plasma medium insert disposed within said cavity;

electrode means cooperatively arranged relative to said cavity for discharging electrical energy in said cavity at a level sufficient to transform a portion of said solid plasma medium insert into generated plasma radicals within said cavity and below a level at which the generated plasma radicals are propelled from the cavity and capable of ignition external to the cavity, whereby electrode erosion is minimized;

first circuitry means cooperatively arranged with said electrode means for controlling the level of current and voltage of electrical energy discharged by said electrode means;

magnetic field generation means for establishing a magnetic field within said cavity, said magnetic field providing a supplemental propelling force on said generated plasma radicals, the strength of said magnetic field being predetermined based upon the energy level of said discharge and the geometry of said cavity so as to propel the generated plasma radicals from the cavity for ignition external to the cavity, whereby ignition and flame propagation are enhanced; and second circuitry means cooperatively arranged with said magnetic field generation means for controlling the generation of said magnetic field.

7. The plasma ignition apparatus of claim 6 wherein said electrode means includes a pair of substantially parallel electrodes and said electrical discharge is established between said pair of electrodes.

8. The plasma ignition apparatus of claim 6 wherein said magnetic field generation means includes a pair of magnetic poles aligned with one another on opposite sides of said cavity.

9. The plasma ignition apparatus of claim 6 wherein said electrical discharge is established in a direction which is substantially perpendicular to said magnetic field.

10. A plasma ignition apparatus designed for generating plasma and for propelling said plasma from said ignition apparatus, said ignition apparatus comprising:

means defining a cavity;

electrical energy discharge means including a pair of substantially parallel electrodes which are cooperatively arranged relative to said cavity and designed and arranged for producing an electrical discharge between said electrodes and within said cavity at a level sufficient to generate plasma at a predetermined location within said cavity and below a level at which the generated plasma is propelled from the cavity and capable of ignition external to the cavity; and magnetic field generation means including a pair of magnetic poles aligned with one another on opposite sides of said cavity and said magnetic field generation means being designed and arranged to establish a magnetic field within said cavity, said magnetic field providing a supplemental propelling force on said generated plasma, said electrical energy being oriented in a direction which is substantially perpendicular to said magnetic field and the strength of said magnetic field being predetermined based upon the energy level of said discharge and the geometry of said cavity so as to propel said generated plasma out of said cavity.

* * * * *